United States Patent [19]

Wilson et al.

[11] 4,403,417

[45] Sep. 13, 1983

[54] DRAW PUNCH

[76] Inventors: Stephen K. Wilson, 18625 88th W.; Raymond I. Beatty, 23610 107th W., both of Edmonds, Wash. 98020

[21] Appl. No.: 385,063

[22] Filed: Jun. 4, 1982

[51] Int. Cl.[3] ..... B26F 1/00

[52] U.S. Cl. ..... 30/360

[58] Field of Search ..... 30/360

[56] References Cited

U.S. PATENT DOCUMENTS

| | | | |
|---|---|---|---|
| 1,817,223 | 8/1931 | Abramson et al. . | |
| 2,096,778 | 10/1937 | Azer . | |
| 2,176,943 | 10/1939 | Reeser . | |
| 2,237,069 | 4/1941 | Christenson . | |
| 2,633,197 | 3/1953 | Nischan . | |
| 3,056,203 | 10/1962 | Calkins . | |
| 3,255,526 | 6/1966 | Molitor . | |
| 3,269,011 | 8/1966 | Herrstrum . | |
| 3,425,219 | 2/1969 | Oliver et al. | 30/360 |
| 3,564,716 | 2/1971 | Burrows . | |

OTHER PUBLICATIONS

Exhibit 1—Catalog distributed by Enerpac (pp. 21, 22 and 23).

Exhibit 2—Catalog distributed by Greenlee Tool Div. of Ex-Cel-O Corp. (pp. 70 and 71).

*Primary Examiner*—Robert C. Watson

*Assistant Examiner*—J. T. Zatarga

*Attorney, Agent, or Firm*—Christensen, O'Connor, Johnson & Kindness

[57] ABSTRACT

A draw punch (10) especially adapted to form holes in sheet metal material (16) includes an elongate draw rod 26 formed with a partially threaded, major diameter section (28) engageable with the stem (18) of an actuator (12). The draw rod (26) also includes a partially threaded minor diameter section (30) insertable within a pilot hole (24) formed in the sheet metal wall (16). A tapered pilot shoulder (32) interconnects the draw rod major and minor diameter sections (28) and (30). A male punch (34) is slidable over the draw rod major diameter section (28) to abut against the actuator (12). A female die (44) includes a disk-shaped backing member (46) slidably engageable over the draw rod minor diameter section (30) and a cylindrical cutting member (52) disposed between the backing member (46) and the punch (34). The cylindrical member (52) has a smaller diameter bore portion (56) adjacent the punch (34) to form a cutting edge with the adjacent end of the punch (34) and a larger diameter clearance bore portion (54) adjacent the die backing member (46). With the punch (34) and the die (44) disposed on opposite sides of the sheet metal wall (16), operation of the actuating means (12) forces the punch and die towards each other to sever an annularly shaped slug (60) from the wall (16).

12 Claims, 4 Drawing Figures

DRAW PUNCH

DESCRIPTION

1. Technical Field

The present invention relates to metal punches, and more particularly to a draw punch specifically adapted to shear uniform, precisely located openings in electrical metal boxes, cabinets and panels for receiving the ends of wire carrying conduits.

2. Background Art

Electrical wires are commonly routed to and from electrical control boxes, cabinets and panels (hereafter generically referred to as "panel") through metal conduits. Typically workmen must form holes in the metal panels to receive the end of the wire carrying conduit. Also, electrical components, such as switches, meters and lights are mounted within the interior of electrical control panels so that they extend outwardly through holes formed in the panels. In the past, these holes have commonly have been formed by using a draw punch. The punch typically includes a female die having a central clearance opening through which is extended a threaded bolt to position the die adjacent to the head of the bolt. The free end of the bolt is threadably engageable with a central threaded through bore formed in a male punch. A pilot hole is first drilled in the panel at the appropriate location and then the bolt is engaged through the pilot hole until the female die abuts against the outside surface of the panel. The male punch is threaded onto the portion of the bolt located within the metal panel. After the punch and die have been pressed tightly against opposite sides of the metal panel, further rotation of the bolt will draw the male punch through the wall of the panel to cut out a slug to thereby form an opening in the panel of a size corresponding to the punch.

After the hole has been formed, the male punch is unthreaded from the bolt for removal of the slug from the female die. As the slug is being severed from the electrical panel it typically assumes the cutting profile of the male punch, which is often V-shaped. As a consequence, the slug tends to bind or "hang up" on the threads of the bolt making it very difficult to remove the slug from the interior of the female die. Moreover, due to the clearance required between the punch and the threads of the bolt to provide for free sliding movement of the punch on the bolt and due to the fact that a punch typically has only two leading points or corners, the male punch rocks about the two points when penetrating the metal panel thereby imposing high bending stresses on the bolts, which not infrequently causes smaller size bolts to break.

Another drawback of conventional draw punches is that to alleviate the tendency of the deformed slug to bind on the threads of the bolt, substantial clearance typically is provided between the pilot hole and the bolt. Consequently, the bolt may not always be centered relative to the pilot hole. The final hole formed in the metal panel may not be concentric with the initial pilot hole thereby resulting in misalignment between the conduit or electrical component and the panel.

Examples of draw punches of the type described above are disclosed by U.S. Pat. Nos. 2,633,179; 3,056,203; 3,255,526; 3,269,011; and 3,564,716. In the '203 patent the bolt, with the male punch attached to its free end, is rotated by an electrically powered actuator. Rather than rotating the bolt to force the male punch and the female die together, in the '197, '526, '011 and '716 patents, the bolt is longitudinally drawn through a clearance hole provided in the center of the female die by a hydraulic actuator which pulls on the end of the bolt opposite the male punch. Moreover, in the '526 patent, a rubber block is disposed within the interior of the female die to help eject the blank after being punched out by the punch. In the '011 patent, the female die is composed of an annularly shaped outer member and a circular backup member which slidably engages within the center of the outer member. The cylindrical outer member includes cutting edges disposed toward the male punch and a relieved rearward portion for receiving the slug removed from the panel wall. In the '176 patent several different size lands are formed in the end of the hydraulic actuator adjacent the female die. The female die itself is cylindrical in shape to pilot over one of the lands.

U.S. Pat. Nos. 1,817,223; 2,096,778 and 2,176,943 disclose draw punches constructed similarly to the type described above, with the exception that the bolt is reversed in direction so that the head of the bolt extends within the electrical box to abut against the back side of the male punch. A nut is threadably engaged over the free end of the bolt which extends outwardly of the electrical box and through a central clearance hole formed in the female die. The male punch and female die are drawn towards each other by rotation of the nut on the bolt. In the '223 patent, a cross hole is formed in the head of the bolt to receive an elongate handle which may be held to prevent the male punch from rotating while the nut is being tightened. The drawbacks of prior art punches, as discused above, also are applicable to this type of draw punch.

U.S. Pat. No. 2,237,069 concerns a draw punch constructed somewhat similarly to the draw punches disclosed in the above-described '223, '788 and '943 patents. However, in the '069 patent the locations of the male punch and female die are reversed so that the punch is on the outside of the electrical panels while the die is disposed within the panel. Also, a series of different diameter lands are formed in the underside of the head of the bolt in a manner similar to that disclosed in the above discussed '716 patent. As in the '716 patent, the female die is generally cylindrical in shape to pilot over one of the lands formed in the bolt head.

DISCLOSURE OF THE INVENTION

The present invention relates to a draw punch specifically adapted for use by electricians to form holes or openings in electrical panels for interconnecting the end of a conduit with the panel or for mounting electrical components to extend outwardly through openings formed in the panels. In forming the opening, a relatively small diameter pilot hole is first drilled through the wall of the electrical panel at a desired location. Thereafter, the draw punch of the present invention is used to enlarge the pilot hole to a diameter corresponding to the size of the conduit or electrical component. The draw punch includes a novel, elongate actuating rod having a major diameter section which is larger than the size of the pilot hole, a minor diameter section engageable through the pilot hole and a tapered or beveled pilot shoulder at the intersection of the rod major and minor diameter sections. The shoulder is sized to bear against the pilot hole to thereby center the actuating rod within the pilot hole. The present invention further includes a male punch having a central clearance hole for slidably and closely engaging the punch over the actuating rod major diameter section. The punch is formed with a die face facing toward the actuating rod minor diameter section.

A female die cooperates with the punch to sever an annularly shaped slug from the metal electrical panel. The die is of two-piece construction and includes a generally disk-shaped retaining or backing member which is closely slidable over the actuating rod minor diameter section. The end of the minor diameter section is threaded to receive a nut. Alternatively, the die retaining member may be formed with a central threaded bore for attachment to the actuating rod. The retaining member includes a reduced diameter pilot boss which extends outwardly from the side of the retaining member opposite the nut and in the direction toward the punch to thereby define an annular shoulder along the perimeter of the retaining member. The die also includes a cylindrical member disposed between the die retaining member and the punch. The end portion of the cylindrical member adjacent the punch is formed with a reduced diameter bore which is sized to snugly, slidably receive the punch. The opposite end portion of the cylindrical member is formed with a larger diameter clearance bore which closely fits over the pilot boss formed in the die retaining member to thereby coaxially align the cylindrical member with the punch.

In the operation of the draw punch of the present invention, the punch is placed over the actuating rod major diameter section and then the rod minor diameter section is inserted into the pilot hole of the electrical panel until the rod beveled shoulder pilots against the pilot hole. This properly centers the punch relative to the pilot hole. Thereafter the die is slidably engaged with the minor diameter section of the actuating rod to position the die cylindrical member against the opposite side of the electrical panel wall from the location of the punch. Next the nut is engaged with the threaded end portion of the rod minor diameter section to retain the die on the rod.

Once the draw punch of the present invention is in place, the punch and die are forced relatively towards each other to sever the sheet metal and produce an annularly shaped slug which is driven by the punch into the larger diameter clearance bore portion of the die cylindrical member. The punch may be driven toward the die by use of a powered actuator which has a central, movable shaft attachable with the free end portion of the actuating rod major diameter section. The shaft slides within a cylindrical housing having an end wall which abuts against the adjacent end of the punch when the actuating rod is drawn into the housing by the shaft. Alternatively, a nut may be engaged with threads formed on the actuating rod major diameter section. As the nut is tightened on the rod, it pushes against the adjacent end of the punch to push the punch toward the die.

Once the slug has been severed from the control panel wall and then driven into the clearance bore portion of the die cylindrical member, the force acting between the punch and die terminates so that the die may be easily removed from the the actuating rod by unscrewing the nut from the rod minor diameter section and then sliding the die backing member along and off the rod. Since the rod minor diameter section is substantially smaller than the size of the pilot hole formed in the electrical panel, even if the slug is deformed as it is severed from the panel wall, it will not tend to lock with the threads of the draw punch minor diameter section. Moreover, because the inside diameter of the die cylindrical member adjacent the retaining member is relieved or englarged from its smaller cutting diameter, the formed slug will not tend to become wedged or locked within the die.

In a further aspect of the present invention, in side elevational profile the forward or cutting end of the male punch is formed in a generally V-shape. Since the punch is annular, forming the leading end of the punch in a V-shape results in two leading, rounded tips. Unlike conventional punches having sharp cutting points, the rounded tips of applicants' punch have sufficient structural integrity to minimize the possibility that the tips will break during normal use while still enabling a slug to be cleanly pierced from the electrical panel.

BRIEF DESCRIPTION OF THE DRAWINGS

The details of one typical embodiment of the present invention will be described in connection with the accompanying drawings, in which.

BEST MODE OF THE INVENTION

Figure 1:
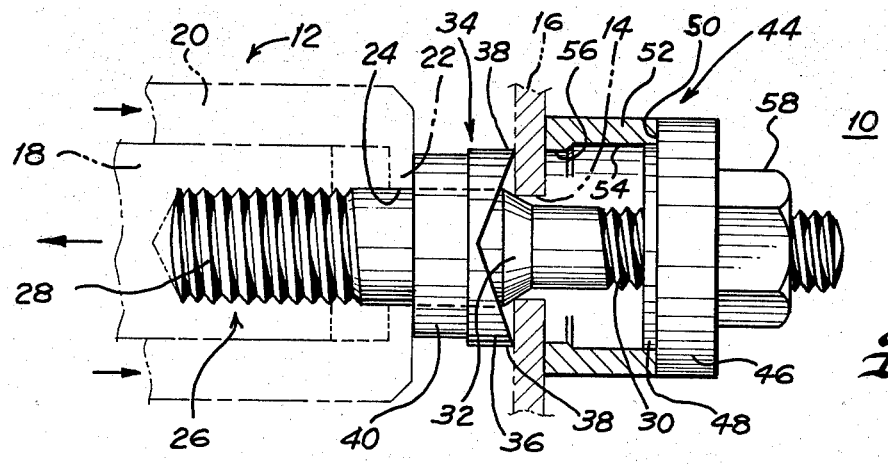
FIG. 1 is a side elevational view of the present invention with portions shown in cross section and illustrated in installed position with the actuating rod beveled shoulder piloted within a pilot hole formed in the wall of an electrical cabinet which is illustrated in phantom line.

Referring initially to FIG. 1, a draw punch 10 constructed according to the best mode of the present invention currently known to applicants is illustrated as installed on an actuating mechanism 12 for enlarging a pilot hole 14 pre-drilled in a wall 16 of an electrical panel or similar structure. The actuating mechanism includes a shaft 18 powered to slide fore and aft within a close fitting bore formed in a surrounding housing 20. The housing includes a substantially flat front face or wall 20 having a central opening 24. The shaft 18 may be powered by various electrical or fluid devices such as an electrical solenoid or a hydraulic cylinder.

Draw punch 10 includes an elongate, circular actuating or draw rod 26 having a major diameter section 28 which is sized to closely slide through actuator housing opening 24. The end portion of rod major diameter 28 is threaded to engage with a correspondingly threaded bore formed in the leading or adjacent end portion of actuator shaft 18. The diameter of rod major section 28, as illustrated in FIG. 1, is slightly larger than the diameter of the pilot hole 14 formed in wall 16. Rod 26 is also formed with a minor diameter section 30 of a size which is significantly smaller than the diameter of pilot hole 14 to enable this section of the rod to engage through the pilot hole. Rod 26 further includes a tapered or beveled pilot shoulder 32 located at the juncture of the rod major and minor diameter sections. As best illustrated in FIG. 1, shoulder 32 is sized to contact against pilot hole 14 to thereby center rod 26 relative to the pilot hole. Although shoulder 32 is illustrated as formed as a straight taper or bevel, it may instead be arcuate or curved in the shape of a radius or filet and still serve its function of centering rod 26 within pilot hole 14. The portions of the rod major and minor diameter sections adjacent shoulder 32 are preferably smooth as illustrated in the drawings.

The draw punch 10 of the present invention also includes a generally annular male punch 34 having a central, circular clearance bore for closely engaging over actuating rod major diameter section 28. In preferred form, punch 34 includes a forward or cutting end portion 36 which is formed with a pair of leading cutting tips 38 directed toward wall 16 of the electrical cabinet. The forward face of punch 34 is defined by two planar surfaces 39A and 39B which are obliquely disposed relative to each other to form a V-shaped profile. The intersection of planar surfaces 39A and 39B with the outer circumference of punch forward end portion 36 define rounded cutting tips 38. Applicants have discovered that by forming draw punch 10 in this manner, cutting tips 38 are substantially stronger than if formed in a conventional manner, wherein the tips are typically ground or otherwise machined into sharp points. As a consequence, tips 38 are not prone to breakage as in conventional draw punches. Moreover, tips 38 tend to remain very sharp, even after extended use. Applicants have further found that although tips 38 are not pointed in the manner of conventional draw punches, draw punch 10 is capable of cleanly severing or punching an enlarged hole in wall 16 without requiring any significantly larger force to be applied to the punch than when utilizing conventional draw punches. Also, tips 38 may be conveniently formed in a one-step operation by, for instance, using a common milling machine to form planar surfaces 35A and 35B in a single pass. Expensive undercutting and/or grinding operations, which are typically used to form conventional punch tips, are not required.

Punch 34 also includes an annular rear or trailing end portion 40 of an outer diameter smaller than the outer diameter cutting end portion 36. Trailing end portion 40 includes a substantially flat rear wall 42 which contacts against the front wall 22 of actuator housing 20.

The present invention also includes a two-piece female die 44 located on the opposite side of panel wall 16 from punch 34. Die 44 includes a generally disk-shaped backing member 46 formed with a central clearance bore which closely fits over minor diameter section 30 of actuating rod 26. A reduced diameter, circular boss 48 projects outwardly from the face of backing member 46 to extend toward punch 34. Boss 46 cooperates with the backing member to define an annularly shaped land or shoulder extending around the perimeter of the backing member. Female die 44 further includes a generally cylindrically-shaped member 52 positioned between backing member 46 and punch 34. Cylindrical member 52 is formed with a larger inner diameter portion 54 which closely engages over boss 48 to thereby coaxially align the cylindrical member with punch 34. The cylindrical member also includes a smaller diameter, leading bore portion 56 which is sized slightly larger than the diameter of punch leading end 36. The smaller inside diameter portion 56 of cylindrical member 52 intersects with the adjacent end 58 of the cylindrical member at a sharp corner to form a cutting edge which cooperates with punch 34 to sever wall 16 as described below.

Although the outer surfaces of punch 34 and die 44 are illustrated as circular in shape, they can be formed in other shapes such as square or rectangular to thereby form square or rectangular holes in wall 16 as desired.

Preferably the free or outer end portion of actuating rod minor diameter section 30 is threaded to receive a backing nut 58 which is nominally tightened against the adjacent surface of die backing member 46. Rather than utilizing a nut 58, if desired, the central bore formed in backing member 46 may itself be threaded to engage with the actuating rod.

Figure 2:
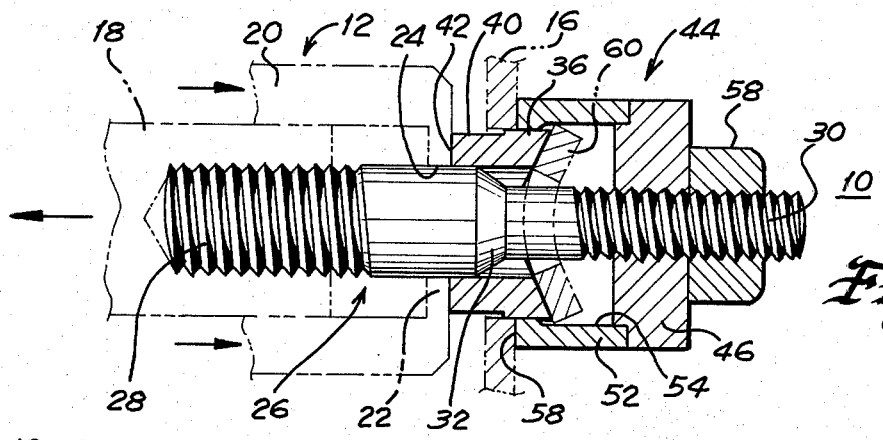
FIG. 2 is a view similar to FIG. 1, illustrating the relative location of the components of the present invention after a slug has been severed from the electrical panel wall.

To utilize the present invention to enlarge pilot hole 14, actuating rod 26 is first threadably engaged with actuator shaft 18 and then punch 34 is placed over the shaft major diameter section 28. The actuating rod is then extended through pilot hole 14 until shoulder 32 bottoms against the pilot hole thereby aligning the punch with the center of the pilot hole. As a consequence, the enlarged hole is formed concentrically in wall 16 with the pilot hole. Next, die 44 is placed over actuating rod minor diameter section 30 so that cylindrical member 52 is positioned adjacent the opposite side of wall 16 from the location of punch 34. Nut 58 is tightened onto the end of the actuating rod to nominally press the cylindrical member 52 against wall 16. Thereafter, actuating mechanism 12 is energized to pull actuating rod 26 in the left hand direction as shown in FIGS. 1 and 2 thereby forcing punch 34 and die 44 towards each other to sever or punch an annularly shaped slug 60 from wall 16. As illustrated in FIG. 2, slug 60 tends to assume the beveled or arcuate shape of the leading end 36 of punch 34. The smooth surface of the portion of the draw rod major diameter section 28 adjacent shoulder 32 enables punch 34 to freely slide over rod 26 when actuating mechanism 12 is energized.

Figure 3:
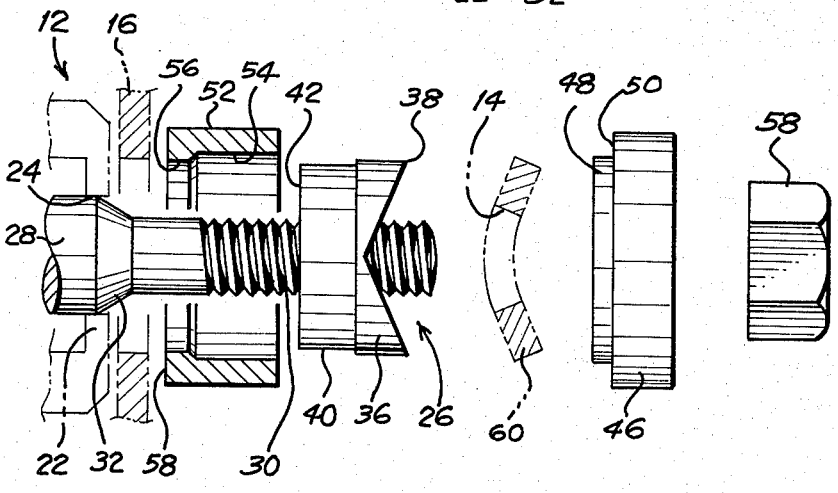
FIG. 3 is a view similar to FIGS. 1 and 2, illustrating the components of the present invention as disassembled to remove the slug from the die.
Figure 4:
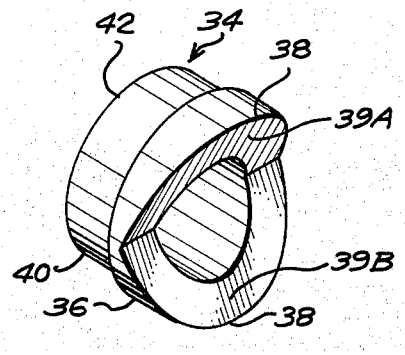
FIG. 4 is an isometric view of the male punch of the present invention specifically illustrating the configuration of the leading or cutting end of the punch.

As illustrated in FIG. 2, after the slug 60 has been severed from wall 16, further travel of the actuating rod causes the slug to be driven into the larger diameter portion 54 of die cylindrical member 52. The slug is removed from die 44 by first unthreading nut 58 from the actuating rod and then slidably disengaging die backing member 46 from rod minor diameter 30. Thereafter slug 60 may be simply slid along the length of the activating rod along with die cylindrical member 52 and punch 44. Since rod minor diameter section 30 is substantially smaller than the size of pilot hole 14, even though the slug is substantially deformed as illustrated in FIGS. 2 and 3 clearance exists between pilot hole 14 and the rod minor diameter to prevent slug 60 from becoming lodged or "hung up" on the rod. In the preferred form of the present invention the threads of the rod minor diameter section are formed by cutting rather than by rolling so that the maximum diameter of the threads is substantially equal to the smooth portion of the minor diameter. This reduces the possibility that slug 60 will become locked with the threads while the slug is being removed from the draw rod. Thus, it will be appreciated that by constructing draw punch 10 as described above, holes can be easily, conveniently and accurately formed in sheet metal, such as in the wall of an electrical control panel.

As an example of the dimensions of a draw rod constructed according to one embodiment of the present invention, the major section 28 of the rod may be formed with a diameter of $\frac{3}{4}$ inch to mate with commonly available actuating mechanisms. The diameter of the minor section 30 of the rod may be approximately $\frac{1}{2}$ inch. With a draw rod formed with these dimensions, the pilot hole 14 is preferably from approximately $\frac{5}{8}$ to $\frac{3}{4}$ of an inch in diameter. A pilot hole formed in this size range is not only small enough to permit convenient and accurate piloting of the rod major diameter section, but also sufficiently large to prevent slug 60 from binding on the rod minor diameter section.

Although draw punch 10 of the present invention is illustrated in FIGS. 1–4 as employed in conjunction with a powered actuating mechanism 12, the draw punch also may be successfully utilized by replacing the actuating mechanism with a nut, not shown, which engages with the screw threads formed in the rod major diameter section 28. Ideally a backing collar, such as collar 62 described above, is interposed between this nut and the punch since ideally screw threads are not formed along the full length of actuating rod major diameter section but instead terminate somewhat short of shoulder 32. Also, preferably the portion of the actuating rod major diameter section along which punch 34 slides is smooth to minimize friction and interference between the actuating rod and the punch.

As will be apparent to those skilled in the art to which the invention is addressed, the present invention may be embodied in forms and embodiments other than those specifically disclosed above, without departing from the spirit or essential characteristics of the invention. The particular embodiment of the draw punch 10 described above is therefore to be considered in all respects as illustrative and not restrictive, i.e. the scope of the present invention is as set forth in the appended claims rather than be limited to the example of the draw punch 10 as set forth in the foregoing description.

What is claimed is:

1. A draw punch for enlarging a pilot hole in a wall, comprising:

(a) an actuating rod having a major diameter section, a minor diameter section and a beveled pilot shoulder interconnecting the rod major and minor diameter sections;

(b) a male punch slidably engageable over the rod major diameter section;

(c) a female die including:

a backing member engageable over the actuating rod minor diameter section, the side of said backing member facing the punch defining piloting means; and a cylindrical member having a smaller, inner diameter portion adjacent the punch to define a cutting face and to snugly, slidably receive the punch, and a larger inner diameter clearance portion engageable with the piloting means to coaxially align the die cylindrical member with the actuating rod; and (d) securing means for preventing disengagement of the die backing member from the actuating rod when the punch and die, which are disposed on opposite sides of the wall, are forced relatively towards each other to sever the wall.

2. The draw punch according to claim 1, wherein said piloting means comprises a pilot boss formed on the side of the die backing member facing the punch for closely engaging within the larger inner diameter portion of the die cylindrical member.

3. The draw punch according to claim 1, wherein the portion of the actuating rod minor diameter section located adjacent the pilot shoulder is smooth.

4. The draw punch according to claim 3, wherein the end of the actuating rod minor diameter section is threaded to engage with the securing means.

5. The draw punch according to claim 1, wherein said securing means comprise:

screw threads formed on the actuating rod minor diameter section; and a threaded bore formed in the die backing member to threadably engage with the actuating rod minor diameter threaded end section.

6. The draw punch according claim 1, wherein said securing means comprise:

screw threads formed on the minor diameter section of the actuating rod;

the backing member of the die is slidably engageable over the actuating rod minor diameter section; and a nut threadably engageable with the threaded minor diameter section of the actuting rod to bear against the side of the die backing member located away from the punch.

7. The draw punch according to claim 1, wherein said male punch having a forward end formed with a plurality of planar face surfaces obliquely disposed relative to each other to each define rounded cutting tips.

8. The draw punch according to claim 7, wherein said male punch forward end portion includes two planar surfaces which together form a V-shaped profile that defines two, diametrically opposed rounded cutting tips.

9. For use with an actuator having a pressing face, a punch and die for enlarging a pilot hold formed in a workpiece, comprising:

(a) a draw rod comprising:

a major diameter section engageable with the actuator for longitudinal shifting of the draw rod relative to the actuator pressing face;

a minor diameter free end section engageable through the pilot hole of the workpiece; and a tapered pilot shoulder at the intersection of the rod major and minor diameter sections, said shoulder sized to pilot against the workpiece pilot hole;

(b) a punch slidably engageable over the draw rod major diameter section and abuttable against the actuator pressing face, the punch having a cutting face facing away from the actuator;

(c) a die comprising:

a backing member detachably engageable with the draw rod minor diameter section;

a cylindrical member disposable between the die backing member and the punch, said cylindrical member having a smaller diameter bore portion adjacent the punch to define a cutting edge with the adjacent end of the punch and a larger diameter clearance bore portion adjacent the die backing member; and positioning means for positioning the die cylindrical member relative to the backing member to align the cylindrical member coaxially with the punch; and (d) wherein with the punch and die disposed on opposite sides of the workpiece, the actuating means forcing the punch and die relatively towards each other for severing the workpiece.

10. The punch and die according to claim 9, wherein the positioning means comprises a reduced diameter pilot boss formed in the side of the die backing member facing the punch for closely engaging within the clearance bore of the die cylindrical member.

11. The punch and die according to claim 9, wherein the portion of the actuating rod minor diameter section located adjacent the pilot shoulder is smooth.

12. The punch and die according to claim 9, wherein the punch cutting face is formed from a plurality of planar surfaces obliquely disposed relative to each other to each define rounded cutting tips.

* * * * *